US006324913B1

(12) United States Patent
Storm

(10) Patent No.: US 6,324,913 B1
(45) Date of Patent: Dec. 4, 2001

(54) METHOD FOR DETERMINING THE OPERATING SPEED, WORKING PRESSURE AND PIVOT ANGLE OF AN AXIAL PISTON UNIT FOR A HYDROSTATIC DRIVE MECHANISM

(75) Inventor: Andreas Storm, Jevenstedt (DE)

(73) Assignee: Sauer-Danfoss Inc., Ames, IA (US)

( * ) Notice: Subject to any disclaimer, the term of this patent is extended or adjusted under 35 U.S.C. 154(b) by 0 days.

(21) Appl. No.: 09/588,069

(22) Filed: Jun. 6, 2000

(30) Foreign Application Priority Data

Jun. 18, 1999 (DE) ..... 199 27 961

(51) Int. Cl.[7] ..... G01N 29/00

(52) U.S. Cl. ..... 73/660; 587/116; 587/593; 587/602

(58) Field of Search ..... 73/570, 593, 602, 73/658, 659, 660, 661, 587, 116, 117.3

(56) References Cited

U.S. PATENT DOCUMENTS 3,783,681 * 1/1974 Hirt et al. ..... 73/119 R
4,252,013 * 2/1981 Hyanova et al. ..... 73/117.3
4,593,555 * 6/1986 Krutz et al. ..... 73/116
5,161,127 * 11/1992 Grosch ..... 367/124
5,797,360 * 8/1998 Pischinger et al. ..... 123/90.11
5,804,726 * 9/1998 Geib et al. ..... 73/593
6,067,847 * 5/2000 Staerzl ..... 73/117.3
6,094,989 * 8/2000 Twerdochlib ..... 73/659

* cited by examiner

*Primary Examiner*—Hezron Williams
*Assistant Examiner*—Jacques Saint-Surin
(74) *Attorney, Agent, or Firm*—Zarley, McKee, Thomte, Voorhees & Sease

(57) ABSTRACT

A method for determining system parameters, such as the operating speed, working pressure and pivot angle of an axial piston unit in which the operating speed, working pressure and pivot angle are determined by means of a frequency analysis of a detected solid-borne sound signal from an axial piston unit of a hydrostatic drive mechanism. A liquid-borne sound signal of airborne sound signal can be used, in which case a respective system parameter is determined by means of a frequency analysis of a detected liquid-borne sound signal or airborne sound signal from the axial piston unit.

6 Claims, 4 Drawing Sheets

METHOD FOR DETERMINING THE OPERATING SPEED, WORKING PRESSURE AND PIVOT ANGLE OF AN AXIAL PISTON UNIT FOR A HYDROSTATIC DRIVE MECHANISM

BACKGROUND OF THE INVENTION

The invention relates to a method for determining system parameters, such as the operating speed, working pressure and pivot angle of an axial piston unit for hydrostatic drives.

Increasing complexity, the comfort desired by customers and users, and new fields of use, lead to the increased use of sensors in hydrostatic drives having axial piston units. These sensors permit the drive to be regulated in an appropriately optimum manner. So that the operating state can be estimated reliably as the starting point for optimum regulation, the operating speed, working pressure or operating pressure and pivot angle of the piston units are important characteristic quantities for the hydrostatic drive. These system parameters for the piston units have hitherto been determined by means of special speed, working-pressure or pivot-angle sensors. A disadvantage of this is that a certain number of sensors of different design and different operating principle are used. This has disadvantages in terms of the costs and the simplification of the hydrostatic drives and also in terms of maintenance and ease of repair.

Therefore, the principal object of the invention is to provide a method for determining the operating speed, working pressure and pivot angle of an axial piston unit, which works with uniform sensors, has a high degree of accuracy in determining the system parameters and makes it possible to have a cost-effective and easily repairable axial piston unit.

These and other objects will be apparent to those skilled in the art.

SUMMARY OF THE INVENTION

By virtue of their discontinuous operation, axial piston units for use in hydrostatic drive systems generate alternating forces which subject the entire axial piston unit to vibrations. Structural vibrations of this kind are referred to as solid-borne sound. When the solid-borne sound is discharged into the air by the piston unit, the solid-borne sound gives rise to airborne sound which, in the case of a corresponding frequency position, is perceptible to the human ear. When the solid-borne sound is discharged, for example, into a hydraulic fluid, the solid-borne sound gives rise to liquid-borne sound.

Since the solid-borne sound is generated on the basis of the alternating forces of the piston unit, and since the alternating forces, in turn, depend on the operating speed, working pressure and pivot angle of the piston unit, the solid-borne sound contains information on these system parameters and therefore makes it possible to evaluate these accordingly. The solid-borne sound is in a fixed functional relation to the alternating forces causing the vibrations, as long as the sound transmission distance from the point of generation of the alternating force to the position of the solid-borne sound sensor mounted on the piston unit does not change. The solid-borne sound signal therefore contains all the information which is also present in the alternating forces.

Drive units of axial piston units usually have an odd number of cylinders or displacement chambers. Nine pistons is a typical number in this case. Since axial piston units can work both as a pump or as a motor, the invention relates, in general, to determining the operating speed, working pressure and pivot angle in axial piston units.

In the preferred embodiment of this invention, the operating speed is determined from the basic frequency of the piston force profile (alternating force) by a frequency analysis of the basic frequency. The basic frequency of the piston force profile is determined from the frequency analysis being divided by the number of pistons of the axial piston unit.

During one complete revolution of an axial piston unit operated as a pump, each displacement chamber is connected to the high-pressure side during half of the revolution and to the low-pressure side during the other half of the revolution. When the corresponding displacement chamber is connected to the high-pressure side, the piston executes a feed stroke. The change-over from high pressure to low pressure, and vice versa, takes place in the dead center positions. Due to compensating flows as a result of hydraulic capacities, the change-over operation lasts for a certain amount of time, i.e., it does not take place infinitely quickly, so that the pressure build-up and pressure reduction in the respective displacement chamber likewise take place at a finite speed. This pressure profile acts on the displacement piston and leads to a dynamic load on the structure of the axial piston unit, thus resulting in a defined profile of the piston force or alternating force. Each individual piston leads to such a piston force profile or profile of the alternating force. If there are a plurality of pistons, the individual piston force profiles induced by the pistons are superposed. Since, the number of pistons of an axial piston unit is known, the piston force or its profile has, during one complete revolution, a maximum number in the piston force profile corresponding to the number of pistons. This piston force leads to a defined solid-borne sound profile, from which these maximum numbers can likewise be derived. It is possible, for example, to determine the operating speed of the axial piston unit from the solid-borne sound profile.

If, however, the axial piston unit runs in the pressureless state, the operating speed of the axial piston unit is determined from vibration components which are determined from the measured unbalances of the drive unit of the axial piston unit. It is thus possible to determine the operating speed both when the pistons are loaded with working pressure or when they are in the pressureless running state.

When the operating speed, as one of the system parameters, is determined, then, the solid-borne sound signal dependent on the piston force is generated, and the solid-borne sound is measured by means of displacement, speed or acceleration pick-ups. A harmonic analysis of this solid-borne sound signal is then carried out, from which its basic frequency is determined.

According to a second embodiment of the invention, the working pressure, as one of the system parameters, is determined from the amplitude of the harmonics which correspond to the number of pistons and which are determined from the frequency analysis. This procedure is possible, since the piston force profile is determined essentially by the profile of the working pressure in the axial piston unit. In this case, a transmission function is set up, which, as a function of the frequency, takes into account amplifications and attenuations of the solid-borne sound signal. That signal results from the structural resonances of the solid-borne signal on its way through structural parts/subassemblies of the axial piston unit to the sensor which is picking up the solid-borne sound. This transmission function therefore likewise ensures that influences of the structure of the parts or of the subassemblies of the axial piston unit on the solid-borne sound signal are taken into account. This increases the accuracy of the method. This weighting result, taking into account the transmission or correction value function, makes it possible to determine the working pressure of the axial piston unit. Preferably, the transmission function is determined empirically. It takes into account various influences, not accurately detectable mathematically, in the material structure or the structural make-up of the components of the axial piston units.

In a third embodiment of the invention, the pivot angle of the axial piston unit is determined from the amplitude ratio of the even harmonic and odd harmonic of the basic frequency of the piston force profile (alternating force) of the axial piston unit. The piston force profile is directly dependent on the solid-borne sound signal and is derived therefrom.

The pivot angle of the axial piston unit is determined through the following steps. First, a solid-borne sound signal dependent on the piston force is generated, specifically by the solid-borne sound signal being measured by means of displacement, speed or acceleration pick-ups. Thence, the harmonic analysis of the solid-borne sound signal is carried out, and its basic frequency and harmonics, including their amplitudes, are determined. Finally, weighting of the harmonics obtained by means of the harmonic analysis is carried out by means of a transmission function, this being followed by the weighting of the amplitude ratios of the even and odd harmonics. The pivot angle is thereafter determined. Preferably, the transmission function is determined empirically and the amplitude ratio is weighted empirically.

A fourth embodiment of the invention involves a method for determining the operating speed, working pressure and pivot angle of an axial piston unit. This system parameter is determined through a frequency analysis of a previously detected liquid-borne sound signal or airborne sound signal of the axial piston unit.

DESCRIPTION OF THE EMBODIMENTS OF THE INVENTION

The invention is explained below by way of example with reference to an axial piston unit with nine pistons. These nine pistons form the basis for explaining the drawings. However, the principle of the invention applies equally to all other numbers of pistons, whether even or odd. The individual drawings are explained on the basis of the axial piston unit working as a pump, i.e., in the pump mode.

Figure 1:
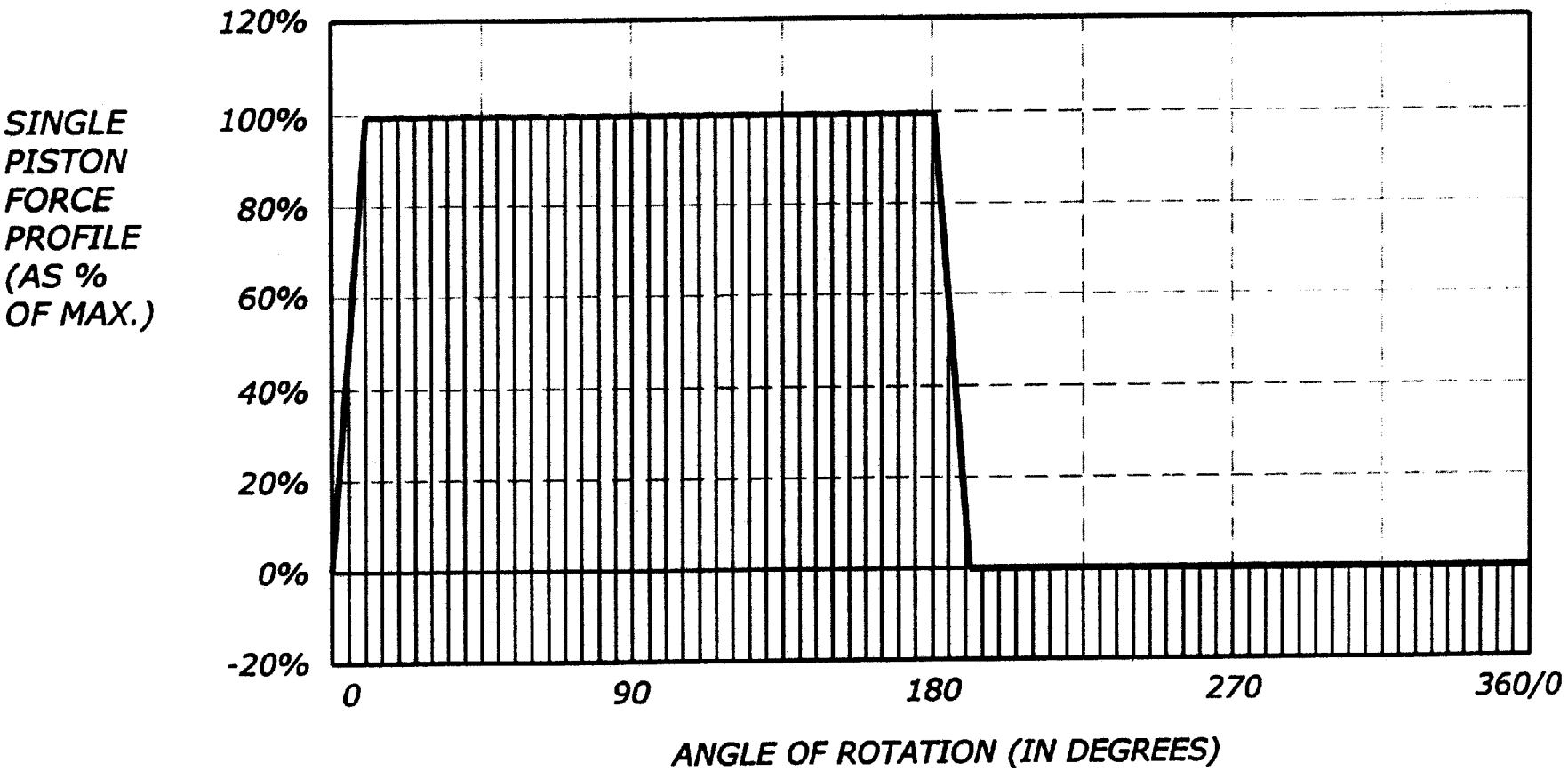
FIG. 1 is a graph showing the piston force profile plotted against the angle of rotation of the axial piston unit for an individual cylinder.

FIG. 1 illustrates the piston force profile against the angle of rotation for one cylinder of an axial piston unit. This profile shows the dynamic load on the unit structure as a result of the prevailing alternating piston force. During one revolution of 360°, each displacement chamber is connected to the high-pressure side over 180° and to the low-pressure side over 180°. When the displacement chamber is connected to the high-pressure side, the piston executes a feed stroke. The change-over from high pressure to low pressure and from low pressure to high pressure takes place in the region of the dead center positions. The function illustrated in FIG. 1 is not a pure rectangular function, since compensating flows as a result of hydraulic capacities necessitate a change-over operation which lasts for a finite amount of time. The pressure build-up and pressure reduction in the respective displacement chamber consequently also does not take place instantaneously.

Figure 2:
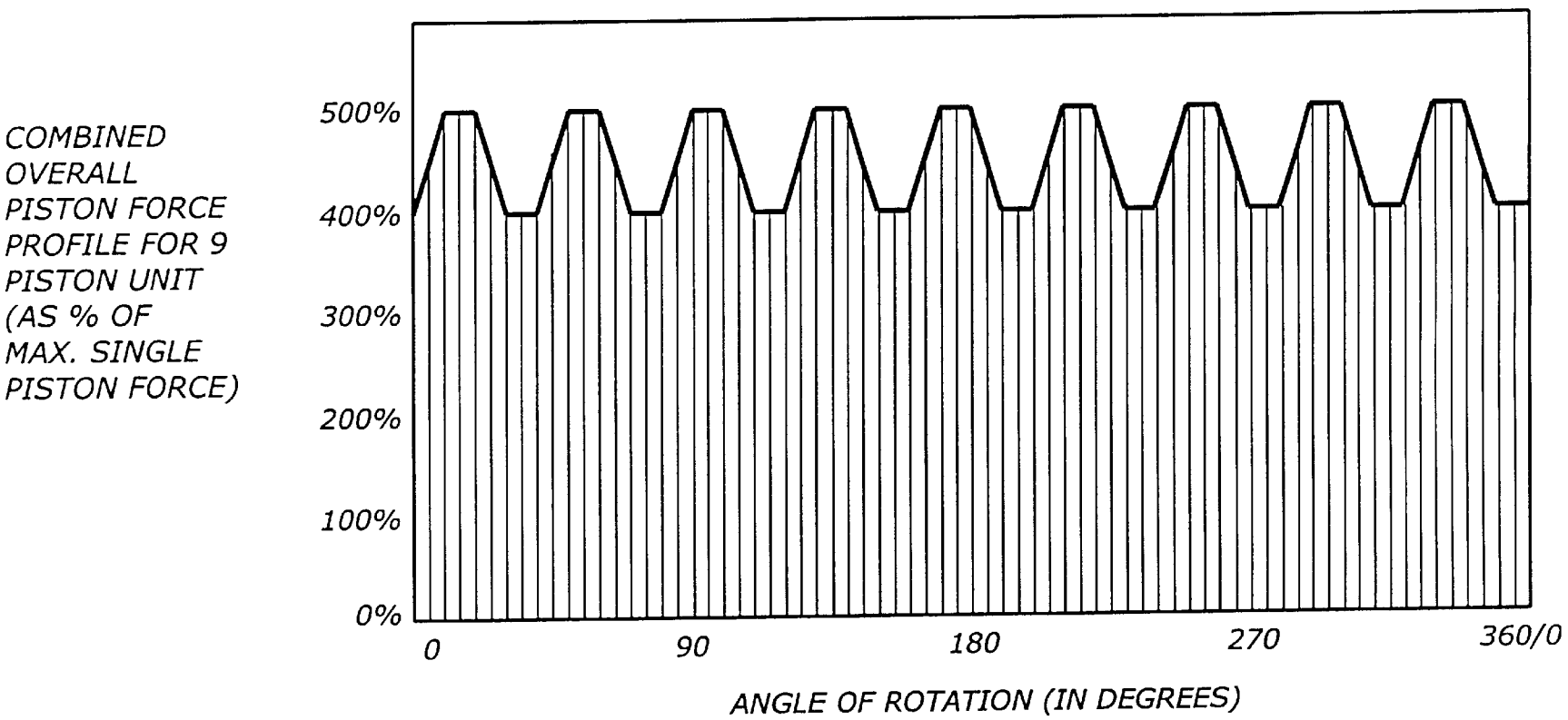
FIG. 2 is a graph showing the overall piston force profile plotted against the angle of rotation of a multi-cylinder axial piston unit.

In the case of an axial piston unit with nine pistons, that is to say with nine displacement chambers, an overall piston force profile or a profile of the overall alternating force against the angle of rotation, as in FIG. 2, is obtained. Thus, in the case of the nine-piston drive unit of the axial piston unit described, an overall piston force profile is obtained which has a maximum value assigned to each piston, in the overall piston force profile.

Both the profile according to FIG. 1, illustrated for one piston, and the profile of the overall piston force according to FIG. 2, illustrated for nine pistons, show that the change-over times for compression and decompression are of about the same length. This is true, however, only when the hydraulic capacities, which are the oil volumes in the displacement chambers, are equal during compression and decompression. This is true only when the pivot angle of the axial piston unit is zero. With an increasing pivot angle, the displacement chamber volumes deviate increasingly from one another in the two dead center positions. While the chamber volume becomes continuously larger during compression it becomes smaller to the same extent during decompression. The result of this is that, in the case of a large pivot angle, the pressure build-up lasts substantially longer and the pressure reduction takes place substantially more quickly. The account taken of these differences in the change-over region and the effects on alternating force are illustrated in FIGS. 3 and 4 respectively.

Figure 3:
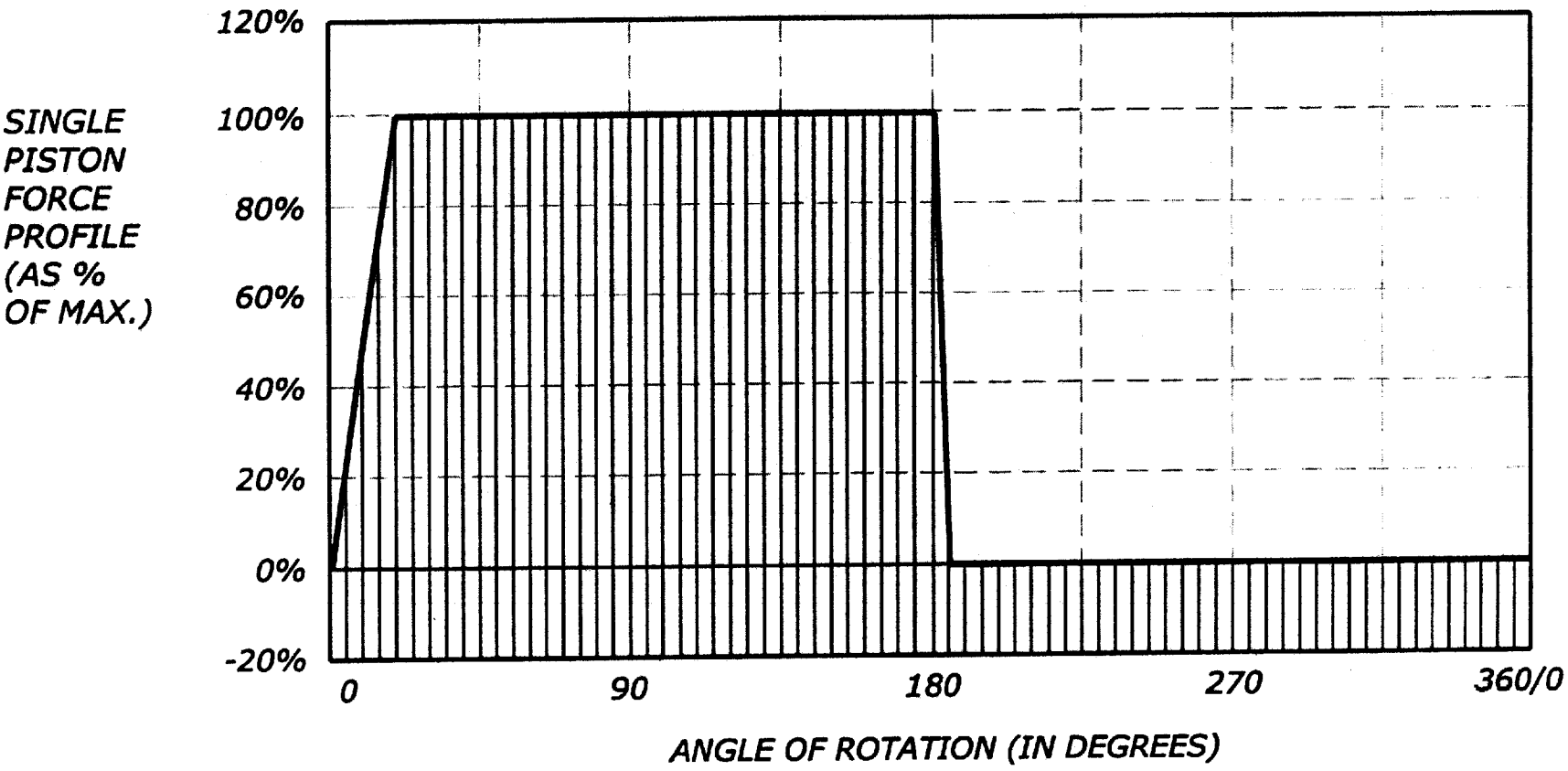
FIG. 3 is a graph showing the profile of the alternating piston force in the case of a large pivot angle.

FIG. 3 illustrates the asymmetry in the profile of the piston force (alternating force) in the case of a large pivot angle, and also in the case of different hydraulic capacities. It is apparent from this that the pressure build-up takes place substantially more slowly than the pressure reduction.

Figure 4:
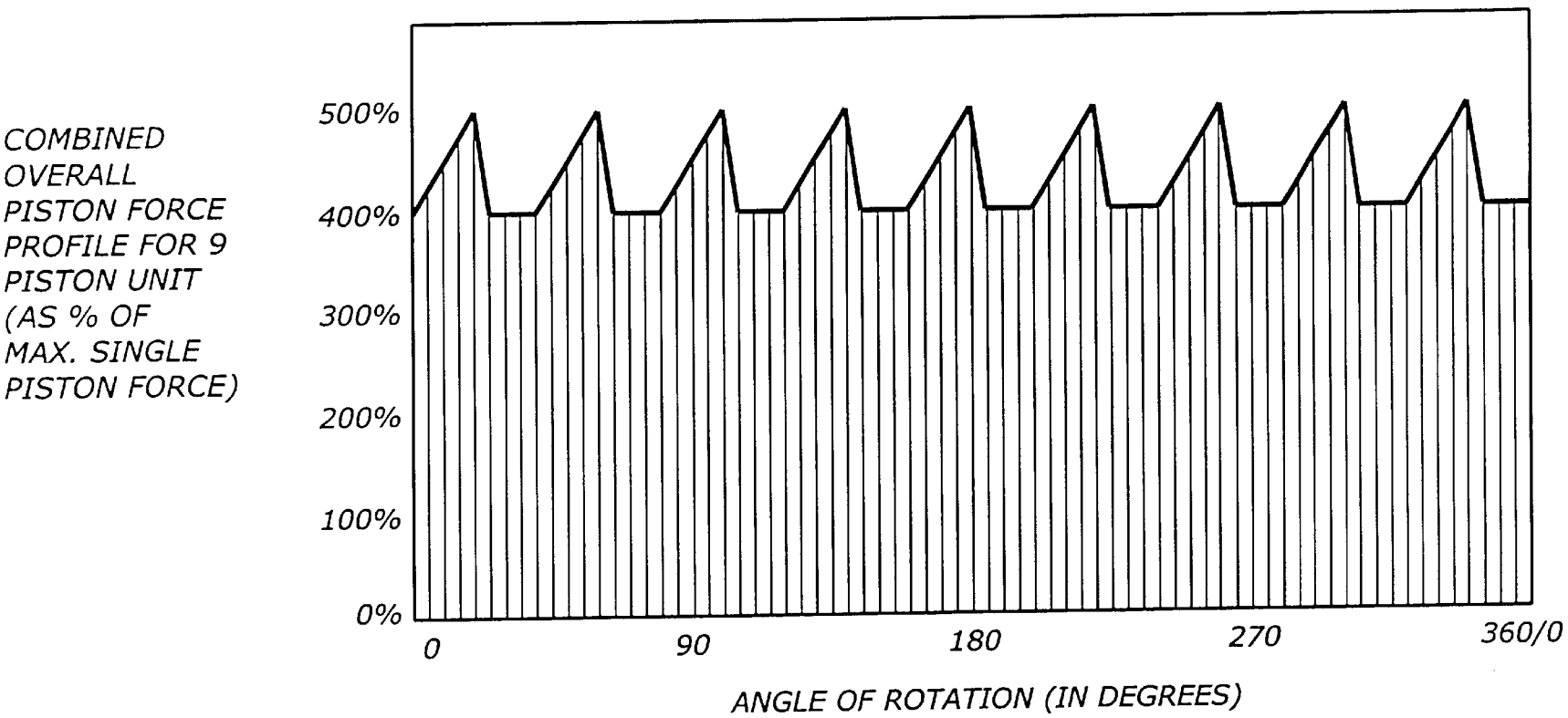
FIG. 4 is a graph showing the overall piston force profile plotted against the angle of rotation of a multi-cylinder axial piston unit in the case of a large pivot angle.

If there is a plurality of pistons, as in the example of FIG. 4, in which the overall piston force profile for a nine-piston drive unit is illustrated, an asymmetric profile of the overall piston force in the region of the signal emitted by an individual cylinder can likewise be seen.

As described above, the profile of the piston force, (the alternating force), is determined not only by constant geometric quantities, such as piston diameter, number of pistons, change-over notches, etc., but critically also by the operating speed, working pressure and pivot angle. Since the profile of the alternating force also contains information on the operating speed, working pressure and pivot angle, the information content relating to the three system parameters mentioned is very high, because it is possible, from the solid-borne sound, to determine the information by means of which the system parameters mentioned are determined. This information becomes clear from or can be derived from the solid-borne sound signal by the latter being subjected to a frequency analysis.

In this case, the operating speed is calculated directly from the basic frequency of the alternating force, divided by the number of pistons. In the pressureless state, the operating speed is determined with the aid of vibration components which result from the unbalance of the drive unit. Information on the working pressure or system pressure is contained in the amplitude of the basic frequency of the alternating force. In this case, it is necessary to take into account the fact that between the amplitude of the alternating force and the solid-borne sound there is a frequency-dependent relation which forms the basis for determining the transmission function. This transmission function takes into account, as a function of the frequency, amplifications and deviations of the solid-borne signal due to structural resonances on its way to a solid-borne sound sensor.

Finally, information on the pivot angle of the axial piston unit can be derived from the amplitude ratio between the even harmonic and the odd harmonic of the basic frequency. In mathematical terms, if the pivot angle is zero, centrosymmetric functions, such as the alternating force, possess only spectral components in the case of a single, threefold, fivefold, sevenfold, etc., basic frequency. These spectral components are referred to as odd harmonics of the basic frequency. The even harmonics (double, fourfold, sixfold, etc., basic frequency) are theoretically absent. If the pivot angle is large, however, this symmetry is no longer present. In the case of large pivot angles, these functions then possess both even and odd harmonics. When the pivot angle is being determined from the amplitude ratio, it must be remembered that between the amplitudes of the alternating force and those of the solid-borne sound there is a frequency-dependent relation which must be taken into account, this being carried via corresponding empirically obtained or derived transmission functions.

The same effects and results can be obtained, using an airborne sound signal instead of the solid-borne sound signal. In addition, it is also possible to use only a measured expansion of a force-flow structure as a signal similar to the solid-borne sound.

What is claimed is:

1. A method for determining the rotational operating speed, working pressure and pivot angle of an axial piston unit for a hydrostatic drive including a plurality of parallel axially reciprocally moveable pistons arranged for rotation about a central axis and capable of assuming variable pivot angle positions, comprising, placing a sound sensor on the piston unit capable of detecting sound from the piston unit indicative of alternating forces imposed upon the pistons due to the working pressure, the rotational operating speed, and the pivot angle position of the pistons in the piston unit and emitting a sound signal in response to said sound from the piston unit, emitting a sound signal from the sensor while the pistons are being rotated about a central axis and axially reciprocated, and making an analysis of the amplitude, frequency and harmonics of the sound signal to determine the working pressure, operating speed, and pivot angle position of the axial piston unit.

2. The method of claim 1 wherein the sensor is a solid-borne sound sensor that emits a solid-borne sound signal, and the solid-borne sound signal is emitted through the structural components of the piston unit.

3. The method of claim 2 wherein a frequency weighting function is determined from the amplification and attentuations of the solid-borne sound signal resulting from the structural resonances of the solid-borne sound signal as the solid-borne sound signal moves through structural portions of the axial piston unit.

4. The method of claim 3 wherein the frequency weighting function is determined empirically.

5. The method of claim 1 wherein the emitted signal is air-borne.

6. The method of claim 1 wherein the emitted signal is liquid-borne.

* * * * *